US011615924B2

(12) United States Patent
Cunningham et al.

(10) Patent No.: US 11,615,924 B2
(45) Date of Patent: Mar. 28, 2023

(54) MEMS SWITCH

(71) Applicants: WiSpry, Inc., Irvine, CA (US); AAC Technologies (Nanjing) Co., Ltd., Nanjing (CN)

(72) Inventors: Shawn Jay Cunningham, Irvine, CA (US); Dana Richard DeReus, Irvine, CA (US)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 17/510,347

(22) Filed: Oct. 25, 2021

(65) Prior Publication Data

US 2022/0130624 A1 Apr. 28, 2022

Related U.S. Application Data

(60) Provisional application No. 63/105,356, filed on Oct. 25, 2020.

(51) Int. Cl.
*H01H 1/00* (2006.01)
*H01H 9/02* (2006.01)

(52) U.S. Cl.
CPC ..... *H01H 1/0036* (2013.01); *H01H 9/02* (2013.01)

(58) Field of Classification Search
CPC ..... H01H 9/02; H01L 29/84; H01L 29/92; H01L 21/50; H01G 5/16; H01G 7/00
USPC ..... 200/238; 361/283.4; 257/415
See application file for complete search history.

(56) References Cited

U.S. PATENT DOCUMENTS 6,160,230 A * 12/2000 McMillan ..... H01H 59/0009 200/181
6,633,212 B1 * 10/2003 Ruan ..... G02B 6/358 359/290
2014/0054728 A1 * 2/2014 Maling ..... H01L 23/34 716/100

* cited by examiner

*Primary Examiner* — Renee S Luebke
*Assistant Examiner* — Iman Malakooti
(74) *Attorney, Agent, or Firm* — W&G Law Group

(57) ABSTRACT

A MEMS switch includes: a housing, a switching assembly; a first actuation electrode, a first contact, a second contact, and a second actuation electrode. The switching device has a stress gradient along the thickness direction, such that in response to applying no voltage between the first actuation electrode and the second actuation electrode, the switching assembly contacts with the first contact. In response to applying a first voltage between the third actuation electrode and the fourth actuation electrode, the switching assembly is driven to deflect such that the switching assembly is spaced apart from both the first contact and the second contact. In response to applying a second voltage between the third actuation electrode and the fourth actuation electrode, the switching assembly is driven to deflect such that the switching assembly contacts with the second contact. The first voltage is smaller than the third voltage.

15 Claims, 13 Drawing Sheets

MEMS SWITCH

TECHNICAL FIELD

The described embodiments relate to the field of micro-electromechanical system (MEMS), and in particular, to a MEMS switch.

BACKGROUND

MEMS switches are used in the field of telecommunication to control electrical, mechanical, or optical signal flows. For example, the MEMS switches may be Digital Subscriber Line (DSL) switch matrices, mobile phones, Automatic Test Equipment (ATE), and other systems that require low-cost switches or require low-cost and high-density switch arrays. However, most MEMS switches are fabricated in an open state and switched to a closed under power. A typical switch is not closed without power.

BRIEF DESCRIPTION OF THE DRAWINGS

In order to describe the technical solutions in the embodiments of the present disclosure more clearly, the drawings required to be used in descriptions of the embodiments will be briefly described below. Obviously, the drawings described below are only some embodiments of the present disclosure, and those skilled in the art may obtain other drawings according to the drawings without creative efforts.

DETAILED DESCRIPTION

Figure 1:
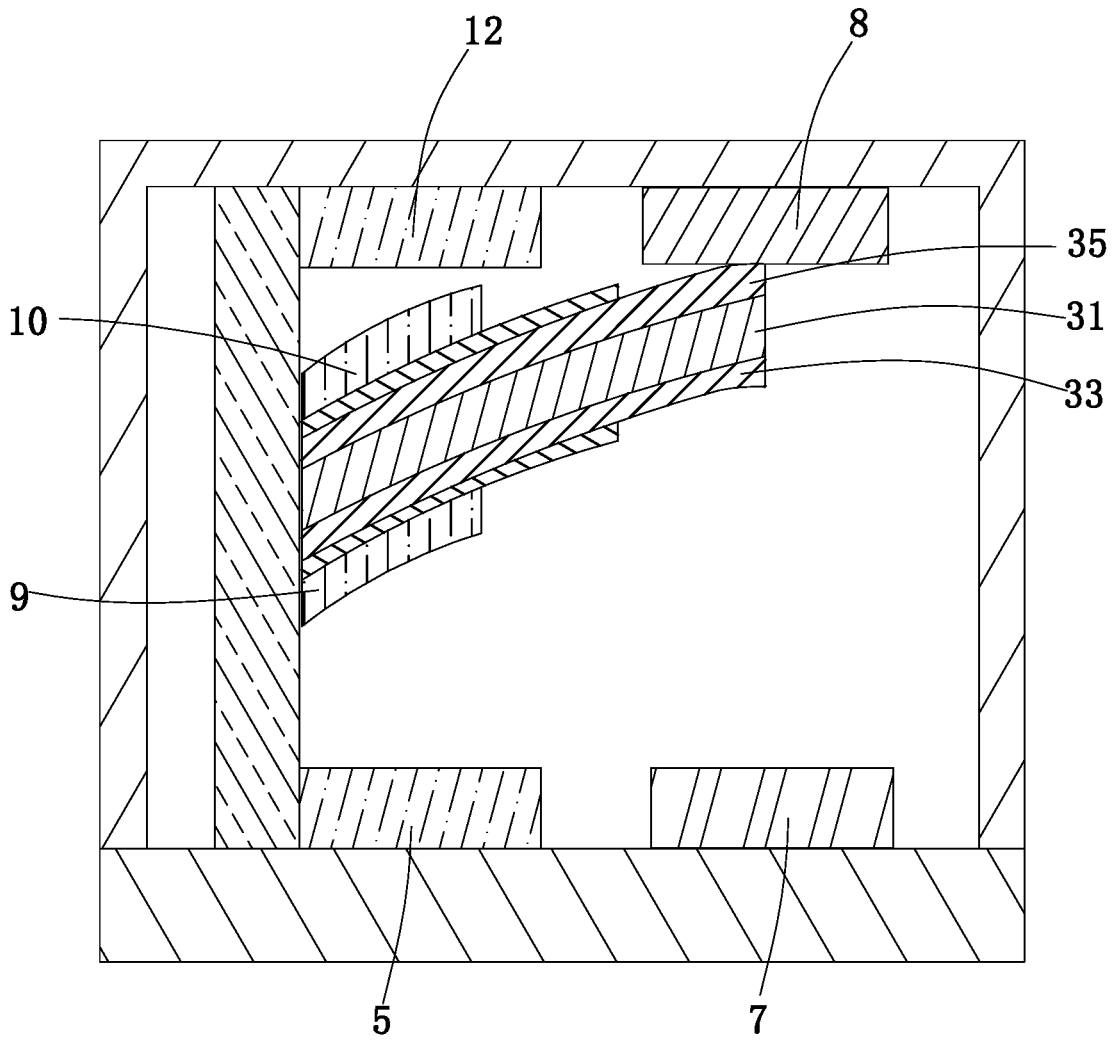
FIG. 1 is a schematic structural view of a MEMS switch in a second closed state according to some embodiments of the present disclosure.

The technical solutions in some embodiments of the present disclosure will be described clearly and completely in conjunction with the drawings in some embodiments of the present disclosure. Apparently, the described embodiments are only a part of the embodiments of the present disclosure, not all the embodiments. Based on the embodiments of the present disclosure, those skilled in the art may acquire other embodiments without making creative efforts. All these embodiments fall within the protection scope of the present disclosure.

In some aspects, a MEMS (micro-electromechanical system) switch may be provided. The MEMS switch may include: a housing, a switching assembly, a first actuation electrode, a first contact, a second actuation electrode, a second contact, a third actuation electrode and a fourth actuation electrode. The switching assembly may be received in the housing and have a first side and a second side opposite to the first side in a thickness direction of the switching assembly. The switching assembly is switchable among a first closed state, a second closed state, and an open state. The first actuation electrode, fixedly arranged on the housing may be disposed at the first side of the switching assembly, and spaced apart from the switching assembly. The first contact may be fixedly arranged on the housing, disposed at the first side of the switching assembly, and spaced apart from the switching assembly and the first actuation electrode. The second actuation electrode may be fixedly disposed on the switching assembly and disposed correspondingly to the first actuation electrode. The second contact may be fixedly arranged on the housing, disposed at the second side of the switching assembly, and spaced apart from the switching assembly. The third actuation electrode may be fixedly arranged on the housing, disposed at the second side of the switching assembly, and spaced from the switching assembly; The fourth actuation electrode may be fixedly disposed on the switching assembly and disposed correspondingly to the third electrode; The switching device has a stress gradient along the thickness direction, such that in response to applying no voltage between the first actuation electrode and the second actuation electrode, the switching assembly is in the first closed state and contacts with the first contact. In response to applying a first voltage between the third actuation electrode and the fourth actuation electrode, the switching assembly is driven to deflect such that the switching assembly is in the open state and spaced apart from both the first contact and the second contact; In response to applying a second voltage between the third actuation electrode and the fourth actuation electrode, the switching assembly is driven to deflect such that the switching assembly is in the second closed state and contacts with the second contact.

In some embodiments, the switching assembly has a first end fixed with respect to the housing and a second end free to displace and rotatable with respect to the housing. A distance from the first actuation electrode to the first end of the switching assembly is less than a distance from the first contact to the first end of the switching assembly.

In some embodiments, the switching assembly further comprises: a core; a first contacting member, disposed on the core at the first side of the switching assembly and facing towards the first contact; and a second contacting member, disposed on the core at the second side of the switching assembly and facing towards the second contact. In response to the switching device being in the first closed state, the first contacting member contacts with the first contact. In response to the switching device being in the second closed state, the second contacting member contacts with the second contact.

In some embodiments, the core comprises at least two sub-layers, and stresses of the at least two sub-layers are different from each other; and/or the first contacting member has a first stress, and the second contacting member has a second stress which is not equal to the first stress; and/or the first contacting member has a first thickness, and the second contacting member has a second thickness which is not equal to the first thickness; and/or the first contacting member has a first pattern, and the second contacting member has a second pattern different from the first pattern; and/or the first contacting member is made of a first material, and the second contacting member is made of a second material different from the first material; and/or a length of the first contacting member in a direction substantially perpendicular to the thickness direction is greater than a length of the core in the direction substantially perpendicular to the thickness direction, and a length of the second contacting member in the direction substantially perpendicular to the thickness direction is less than the length of the core; and/or the core is in shape of a step; and/or the core is made of metal and has a stress gradient in the thickness direction.

In some embodiments, the switching assembly further comprises: a first dielectric member, fixed at one side of the first contacting member opposite to the core, and a second dielectric member, fixed at one side of the second contacting member opposite to the core. The first contacting member has a first contacting portion, and the first contacting portion is exposed from the first dielectric member and capable of contacting with the first contact when the switching assembly in the first closed state. The second contacting member has a second contacting portion, and the second contacting portion is exposed from the second dielectric member and capable of contacting with the second contact when the switching assembly is in the second closed state.

In some embodiments, the second actuation electrode is fixedly disposed on a surface of the first dielectric member that faces away from the first contacting member.

In some embodiments, each of a thickness of the first dielectric member and a thickness of the second dielectric member is less than a thickness of the core.

In some embodiments, each of the core, the first dielectric member, and the second dielectric member is made of oxide.

In some embodiments, the housing comprises: a substrate, and a cover, assembled with the substrate, wherein the cover and the substrate cooperatively form a receiving space, and the switching assembly is disposed in the receiving space. The first actuation electrode and the first contact are fixedly disposed on the substrate. The second contact is fixedly disposed on the cover.

In some embodiments, the MEMS switch further comprises a first fixing member. The switching assembly has a first end fixedly connected to the substrate via the first fixing member and a second end opposite to the first end. The second end of the switching assembly is free to displace and rotatable with respect to the housing; or the second end of the switching assembly is supported by an elastic member; or the second end of the switching assembly is fixedly connected to the substrate via a second fixing member.

In some embodiments, the first actuation electrode and the first contact are disposed at the same side of the first contacting member that is opposite to the core.

In some aspects, a MEMS (micro-electromechanical system) switch may be provided. The MEMS switch may include: a housing, a switching assembly, a first actuation electrode, a first contact, a second actuation electrode, a second contact, a third actuation electrode and a fourth actuation electrode. The switching assembly may be received in the housing and have a first side and a second side opposite to the first side in a thickness direction of the switching assembly. The first actuation electrode may be fixedly arranged on the housing and disposed at the first side of the switching assembly. The first contact may be fixedly arranged on the housing and disposed at the first side of the switching assembly. The second actuation electrode may be fixedly disposed on the switching assembly and disposed correspondingly to the first actuation electrode. The second contact may be fixedly arranged on the housing and disposed at the second side of the switching assembly. The switching assembly is configured in such a way that the switching assembly contacts with the first contact and a short circuit is formed between the first contact and the switching assembly in response to applying no voltage between the first actuation electrode and the second actuation electrode.

In some embodiments, the switching assembly comprises: a core; a first contacting member, disposed on the core at the first side of the switching assembly and facing towards the first contact; and a second contacting member, disposed on the core at the second side of the switching assembly and facing towards the second contact. In response to applying a first voltage between the third actuation electrode and the fourth actuation electrode, the switching assembly is deflected such that the first contacting member is spaced apart from the first contact and the second contacting member is spaced apart from the second contact. In response to applying a second voltage between the third actuation electrode and the fourth actuation electrode, the switching assembly is deflected towards the second contact such that the second contacting member is capable of contacting with the second contact.

In some embodiments, the core comprises at least two sub-layers, and stresses of the at least two sub-layers are different from each other; and/or the first contacting member has a first stress, and the second contacting member has a second stress which is not equal to the first stress; and/or the first contacting member has a first thickness, and the second contacting member has a second thickness which is not equal to the first thickness; and/or the first contacting member has a first pattern, and the second contacting member has a second pattern different from the first pattern; and/or the first contacting member is made of a first material, and the second contacting member is made of a second material different from the first material; and/or a length of the first contacting member in a direction substantially perpendicular to the thickness direction is greater than a length of the core in the direction substantially perpendicular to the thickness direction, and a length of the second contacting member in the direction substantially perpendicular to the thickness direction is less than the length of the core; and/or the core is in shape of a step; and/or the core is made of metal and has a stress gradient in the thickness direction.

In some embodiments, the switching assembly has a first end fixed with respect to the housing and a second end free to displace and rotatable with respect to the housing. A distance from the first actuation electrode to the first end of the switching assembly is less than a distance from the first contact to the first end of the switching assembly.

In some embodiments, the switching assembly further comprises: a first dielectric member, fixed at one side of the first contacting member opposite to the core, and a second dielectric member, fixed at one side of the second contacting member opposite to the core. The first contacting member has a first contacting portion, and the first contacting portion is exposed from the first dielectric member and capable of contacting with the first contact when the switching assembly in the first closed state. The second contacting member has a second contacting portion, and the second contacting portion is exposed from the second dielectric member and capable of contacting with the second contact when the switching assembly is in the second closed state.

In some embodiments, the second actuation electrode is fixedly disposed on a surface of the first dielectric member that faces away from the first contacting member.

In some embodiments, each of a thickness of the first dielectric member and a thickness of the second dielectric member is less than a thickness of the core.

In some embodiments, the housing comprises: a substrate, and a cover, assembled with the substrate, wherein the cover and the substrate cooperatively form a receiving space, and the switching assembly is disposed in the receiving space. The first actuation electrode and the first contact are fixedly disposed on the substrate. The second contact is fixedly disposed on the cover.

In some embodiments of the present disclosure, a MEMS switch may be disclosed. The MEMS switch may have an open state and at least one closed state. The MEMS switch may be operated through many actuation mechanisms including an electrostatic mechanisms, an electromagnetic mechanisms, an electrothermal mechanisms, a piezoelectric mechanisms, a shape-memory mechanisms, a solid-state (SOI, GaAS) mechanisms, or the like, such that the MEMS switch may be switched between the open state and the at least one closed state.

Figure 2:
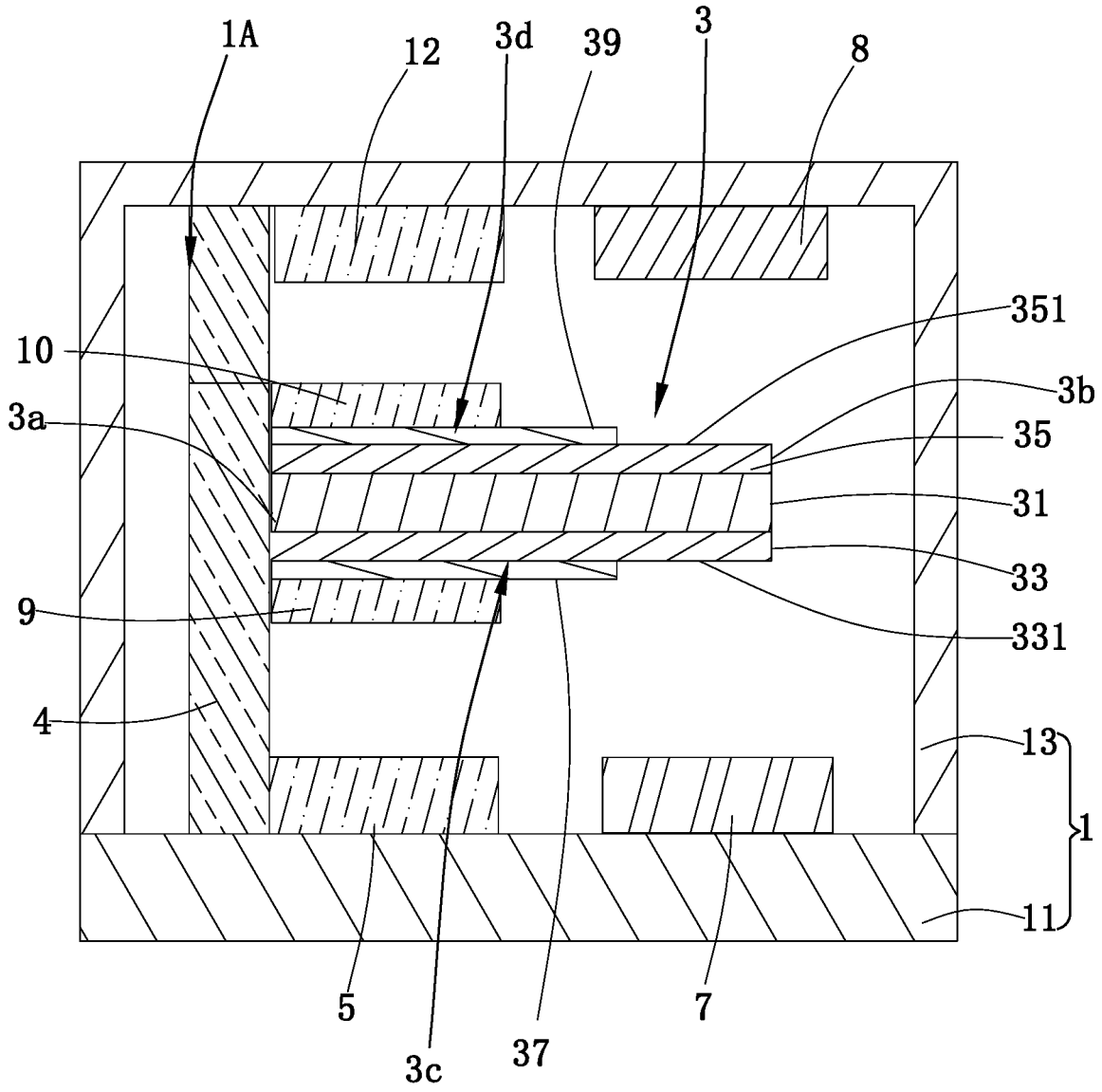
FIG. 2 is a schematic structural view of a MEMS switch in an open state according to some embodiments of the present disclosure.
Figure 3:
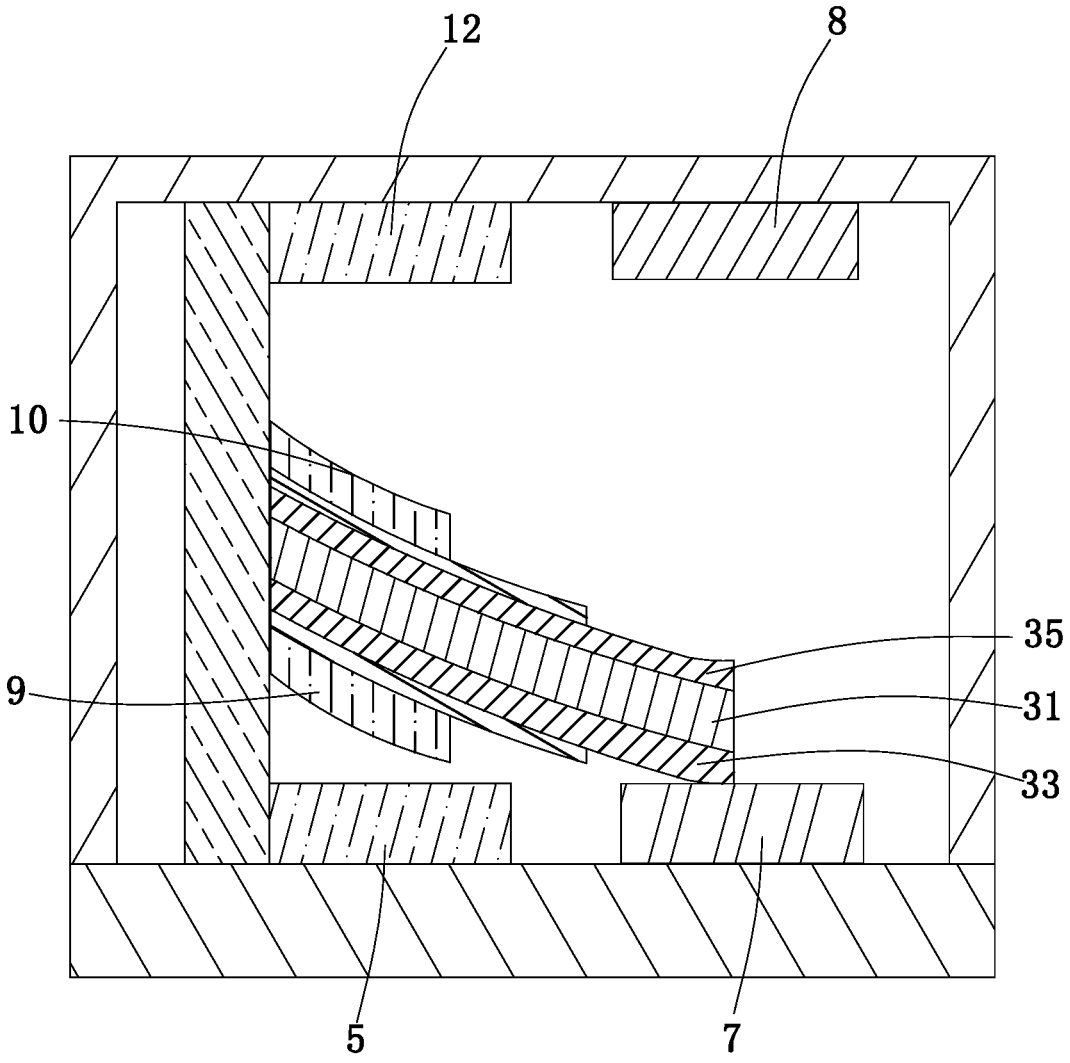
FIG. 3 is a schematic structural view of a MEMS switch in a first closed state according to some embodiments of the present disclosure.

FIG. 1 is a schematic structural view of the MEMS switch according to some embodiments of the present disclosure. In some embodiments, the MEMS switch may be a normally closed switch. The MEMS switch shown in FIG. 1 may be a tri-state switch having one open state and two closed states (including a first closed state (referred as "CLOSED1" in the following) and a second closed state (referred as "CLOSED2" in the following)), and powered to be switched among the OPEN state, the CLOSED1 state, and the CLOSED2 state. As shown in FIG. 3, the MEMS switch is normally in the first closed state/CLOSE1 state. In the CLOSE1 state, the MEMS is also supplied with actuation forces. When the MEMS switch is supplied with a first actuation force, the MEMS switch is switched to the open state as shown in FIG. 1. When the MEMS switch is supplied with a second actuation force, the MEMS switch is switched to the CLOSED2 state as shown in FIG. 2. In other embodiments, the MEMS switch may be a two-state switch having one open state and one closed state, and may be powered to be switched between the open state and the closed state. When the MEMS switch is not supplied with actuation forces, the MEMS switch is normally in the closed state. Of course, in some embodiments, the MEMS switch may be switched among four or more states, which will not be limited in some embodiments of the present disclosure.

Figure 5:
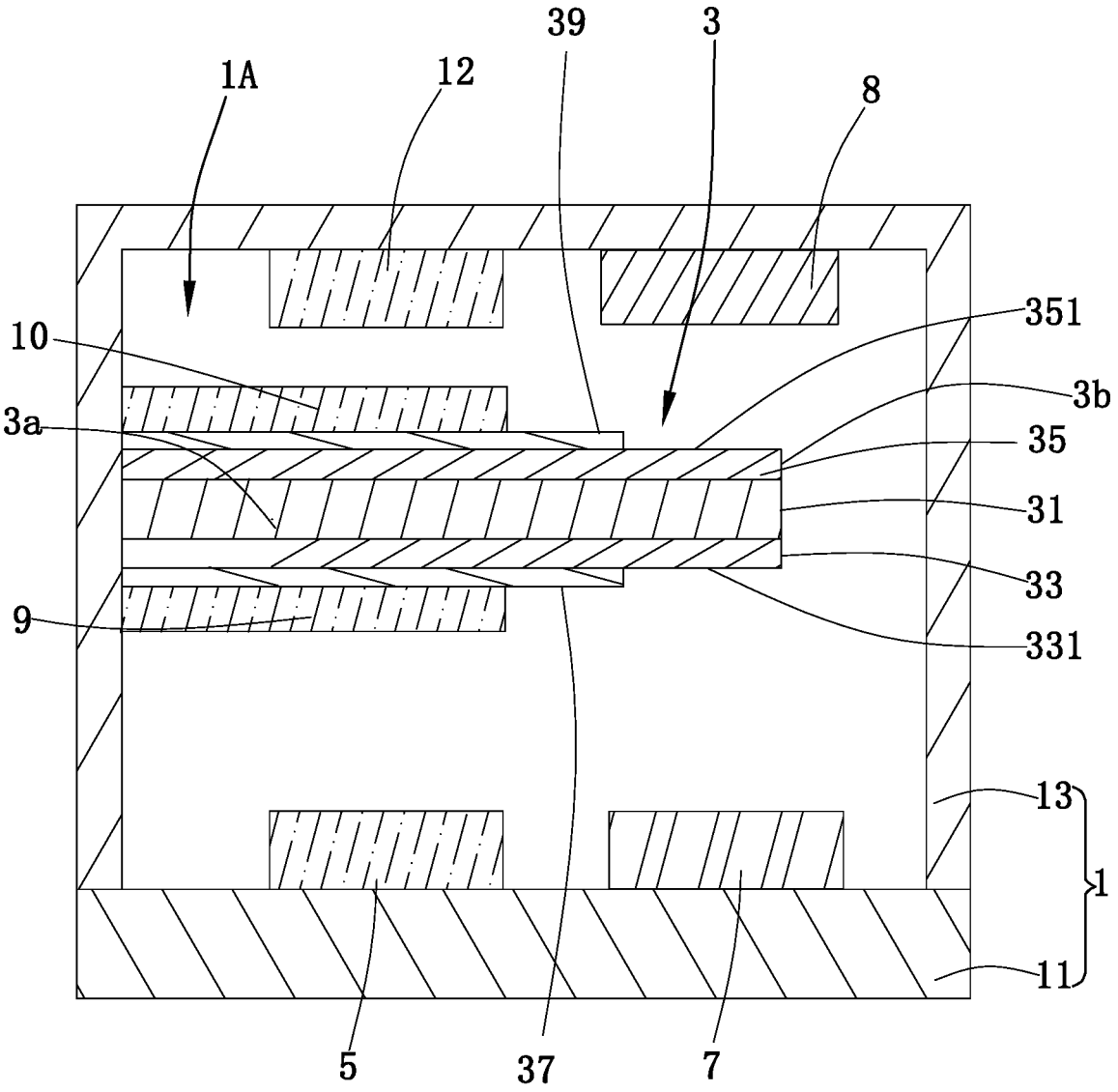
FIG. 5 is a schematic structural view of a MEMS switch without a fixing member compared with the MEMS switch in FIG. 1 according to some embodiments of the present disclosure.

More specifically, as shown in FIG. 1, the MEMS switch may include a housing 1 and a switching assembly 3. In some embodiments, the housing 1 may define a receiving space 1A. The switching assembly 3 may be received in the receiving space 1A of the housing 1. In some embodiments, the switching assembly 3 may be a movable beam, and may be specifically implemented as a cantilever as shown in FIG. 1. The switching assembly 3 may include a first end 3A and a second end 3B. The first end 3A may be a fixed/constrained end. In some embodiments, the displacement of the first end 3A is zero and a slope at the first end 3A may be zero such that there is no rotation at the first end 3A. The first end 3A may be fixedly connected to the housing 1 via a fixing member 4, and may be fixed with respect to the housing 1. The second end 3B may be a free end and may be free to displace and rotatable without constraint except for stiffness. The switching assembly 3 may be driven to deflect or curl, such that the free end 3B of the switching assembly 3 may be further movable or deflectable about the first end 3A which is fixed to the fixing member 4. Of course, in some embodiments, as shown in FIG. 5, it is also possible to omit the fixing member 4, that is to say, the first end 3A may be directly and fixedly connected to the housing 1 without the fixing member 4.

As further shown in FIG. 1, the switching assembly 3 may include a first side 3C and a second side 3D opposite to the first side 3C. The switching assembly 3 may further include a core 31, a first contacting member 33, and a second contacting member 35. The first contacting member 33 and the second contacting member 35 may be disposed or further fixed at two opposite sides of the core 31. More specifically, the first contacting member 33 may be disposed at the first side 3C of the switching assembly 3, while the second contacting member 35 may be disposed at the second side 3D of the switching assembly 3. In some embodiments, the first contacting member 33 and the second contacting member 35 may be directly disposed on the core 31 and further contact with the core 31. The first contacting member 33 and the second contacting member 35 may act as a metal ohmic contact or as a conduction path.

In some embodiments, the core 31 may be a dielectric core, a metal core (such as an all-metal core), a semiconductive core, or the like. That is to say, the core 31 may be made of dielectric material (e.g. silicon oxide), metal (e.g. copper), or semiconductor (e.g. polysilicon). In some embodiments, when the core 31 is a dielectric core, the core 31 may be made of oxides. The oxide may be selected from the group consisting of silicon oxide, silicon nitride, and aluminum oxide.

In some embodiments, the first contacting member 33 and the second contacting member 35 may be made of metal, that is to say, the first contacting member 33 and the second contacting member 35 may be implemented as a metal layer. In some other embodiments, the first contacting member 33 and the second contacting member 35 may be made of alloy.

In some embodiments, the MEMS switch may further include a first actuation electrode 5 and a first contact 7 spaced apart from each other. The first actuation electrode 5 and the first contact 7 may be fixedly arranged on the housing 1 at the first side 3C and face towards the first contacting member 33. The first actuation electrode 5 and the first contact 7 may be further spaced apart from the first contacting member 33 of the switching assembly 3. That is to say, the first actuation electrode 5 and the first contact 7 may be disposed at the same side of the first contacting member 33 that faces away or is opposite to the core 31. In some embodiments, a distance from the first actuation electrode 5 to the first end 3A of the switching assembly 3 may be less than a distance from the first contact 7 to the first end 3A of the switching assembly 3.

Similarly, the MEMS switch may further include a second contact 8. The second contact 8 may be fixedly arranged on the housing 1 at the second side 3D of the switching assembly 3 and further face towards the second contacting member 35. The second contact 8 may be further spaced apart from the second contacting member 35 of the switching assembly 3. That is to say, the second contact 8 may be disposed at one side of the second contacting member 35 that faces away or is opposite to the core 31.

In some embodiments, a second actuation electrode 9 may be fixedly connected to the switching assembly 3 and movable along with the switching assembly 3. More specifically, the second actuation electrode 9 may be directly disposed on or contact with the first contacting member 33 at the first side 3C, that is, at one side that faces away or is opposite to the core 31. The second actuation electrode 9 may be disposed correspondingly to the first actuation electrode 5 and face the first actuation electrode 5. The second actuation electrode 9 may be further spaced apart from the first actuation electrode 5.

In some embodiments, the MEMS switch may further include a third actuation electrode 12 fixedly arranged on the housing 1 and spaced apart from the second contact 8. The third actuation electrode 12 faces towards the second contacting member 35. Similarly, a fourth actuation electrode 10 may be fixedly connected to the switching assembly 3 and movable along with the switching assembly 3. More specifically, the fourth actuation electrode 10 may be directly disposed on or contact with the second contacting member 35 at the second side 3D. The fourth actuation electrode 10 may be disposed correspondingly to the third actuation electrode 12 and face the third actuation electrode 12. The fourth actuation electrode 10 may be further spaced apart from the third actuation electrode 12.

In some embodiments, the switching assembly 3 may have an intrinsic stress gradient to cause the switching assembly 3 to curl and deflect such that the switching assembly 3 may come into contact with the first contact 7 or the second contact 8, or may be spaced apart from the first contact 7 and the second contact 8 without contacting with the first contact 7 and the second contact 8. For example, as shown in FIG. 3, the switching assembly 3 curls towards to the first contact 7 because of the intrinsic stress. This is the normally CLOSED1 state. In the CLOSED1 state, there is no voltage applied on the first actuation electrode 5 and the second actuation electrode 9. That is to say, the switching assembly 3 contacts with the first contact 7 only because of the intrinsic stress. It should be noted that, FIG. 1 shows the open state of the MEMS switch. When applying voltage on the third actuation electrode 12 and the fourth actuation electrode 10, the switching assembly 3 is pulled up to break the contact with the first contact 7. However, as stated above, the MEMS switch is normally closed, and the first contacting member 33 normally contacts with the first contact 7 in response to stopping applying actuation voltage on the third actuation electrode 12 and the fourth actuation electrode 10.

In some embodiments, the switching assembly 3 may have stress gradient in a thickness direction of the switching assembly 3, such that the switching assembly 3 may be caused to curl or deflect to displace and close against the first contact 7. So, the switching assembly 3 can deflect to contact with the first contact 7. The contact force in the normally CLOSED1 state is the only effect of the stress gradient of the switching assembly 3. It should be noted that there are two work way of the MEMS switch shown in FIG. 1-FIG. 3. In the first way, when the stress gradient is big enough to make the switching assembly 3 curl so that the switching assembly 4 can contact with the first contact 7. The first actuation 5 and the second actuation electrode 9 are not needed to contribute to the normally CLOSED1 state. However, in the second way, when the stress gradient is not big enough to make the switching assembly 3 curl to contact with the first contact 7, voltage can be applied on the first actuation 5 and the second actuation electrode 9 to make the switching assembly 3 deflect to contact with the first contact 7, achieving the normally CLOSED1 state.

Figure 4:
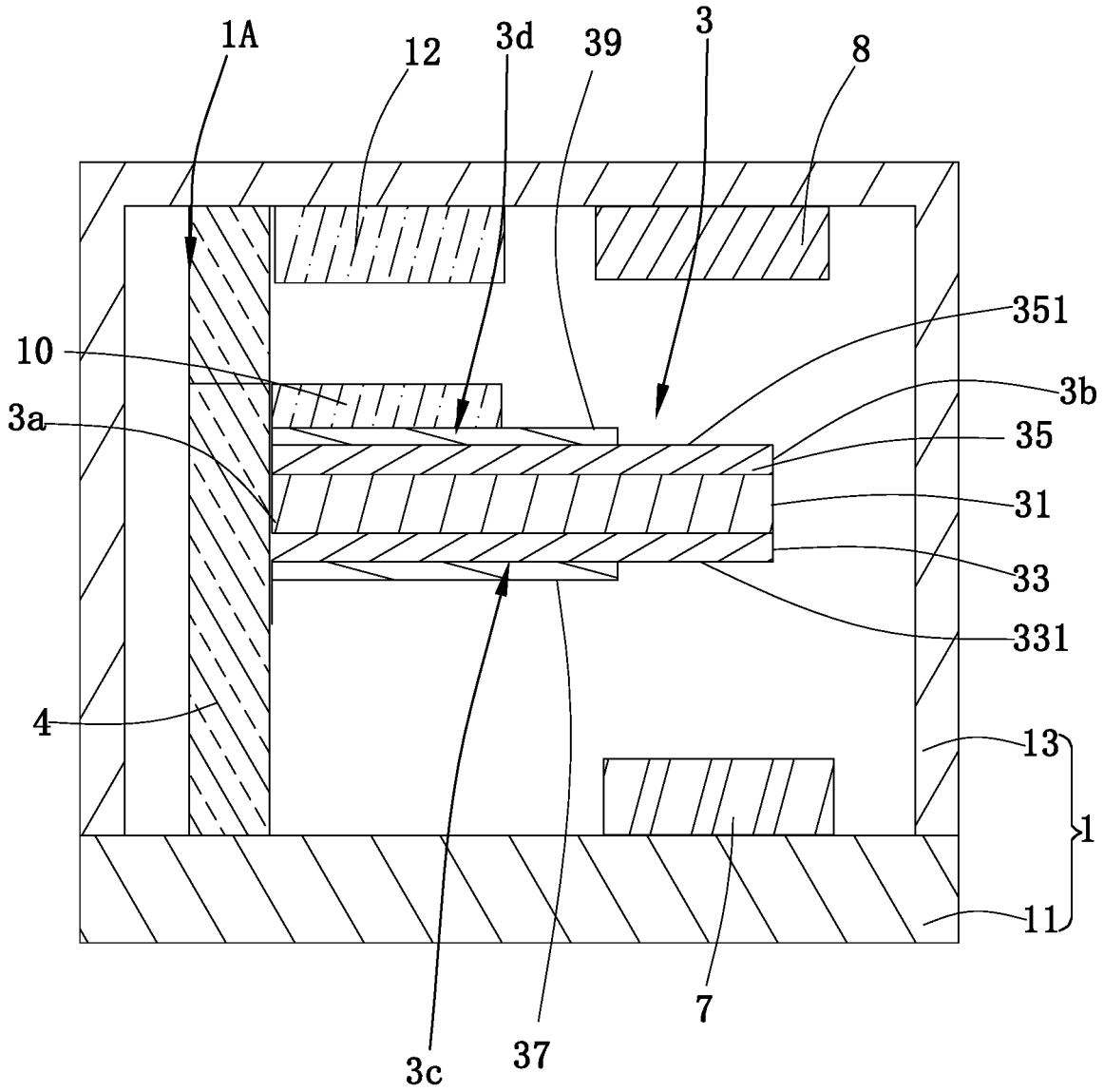
FIG. 4 is a schematic structural view of a MEMS switch without a first actuation electrode and a second actuation electrode compared with the MEMS switch in FIG. 1 according to some embodiments of the present disclosure.

Furthermore, in some other embodiments, as shown in FIG. 4 the MEMS switch does not include the first actuation electrode 5 and the second actuation electrode 9. In this embodiment, the MEMS switch can only work in one way. The switching assembly 3 contacts with the first contact 7 only because of the stress gradient. The stress gradient makes the switching assembly 3 curl to contact with the first contact 7.

The stress gradient of the switching assembly 3 can be produced in many ways that have different positive or negative attributes. The stress gradient can be described as the change in stress divided by the change in thickness through the thickness of the switching assembly 3: $\Delta\sigma/\Delta t$, wherein $\sigma$ is the stress and t is thickness. There are many ways to produce a stress gradient.

For example, in some embodiments, the core 31 may be an oxide core formed by depositing on the first contacting member 33. The first contacting member 33 and the second contacting member 35 may be the same, that is, have the same configuration including shape and size. In this case, it is possible to modify the deposition conditions of the core 31. For example, a deposition temperature or a power of the radio frequency may be changed to produce a variation in the stress in the thickness direction of the switching assembly 3.

Figure 6:
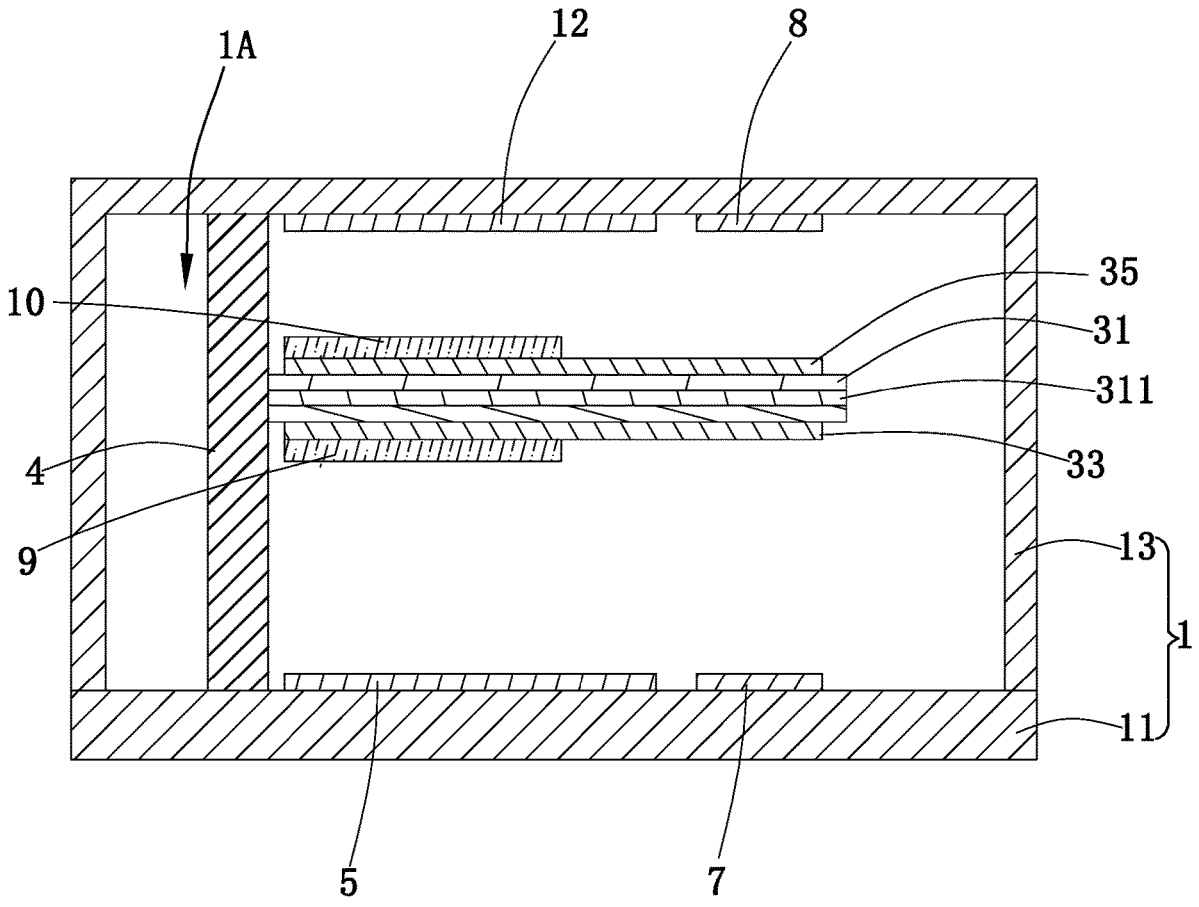
FIG. 6 is a schematic structural view of a MEMS switch with a core including three sub-layers according to some embodiments of the present disclosure.

In some embodiments, the core 31 may be divided into at least two sub-layers 311, and each sub-layer 311 may have a different stress. That is to say, the stresses of the at least two sub-layers 311 may be different from each other. For example, as shown in FIG. 6, the core 31 may be divided into three sub-layers 311.

Figure 7:
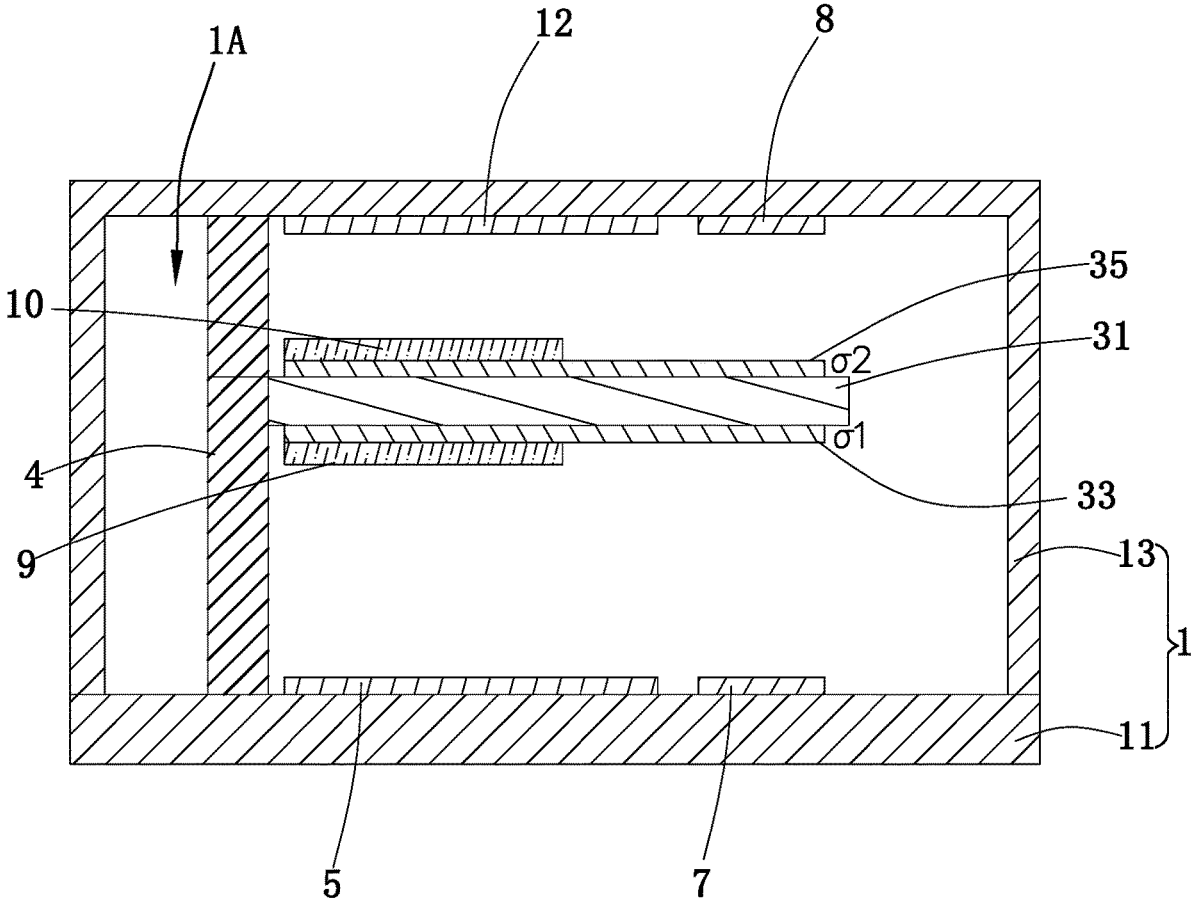
FIG. 7 is a schematic structural view of a MEMS switch including a first contacting member and a second contacting member with different stress according to some embodiments of the present disclosure.

In some embodiments, as shown in FIG. 7, the core 31 may have a uniform average stress (that is, no stress gradient occurs in the core 31). However, the first contacting member 33 and the second contacting member 35 may be different from each other such that a stress gradient may be produced in the thickness direction of the switching assembly 3. For example, as shown in FIG. 7, the first contacting member 33 may have a first stress $\sigma 1$, while the second contacting member 35 may have a second stress $\theta 2$, and $\sigma 1 \neq \sigma 2$.

Figure 8:
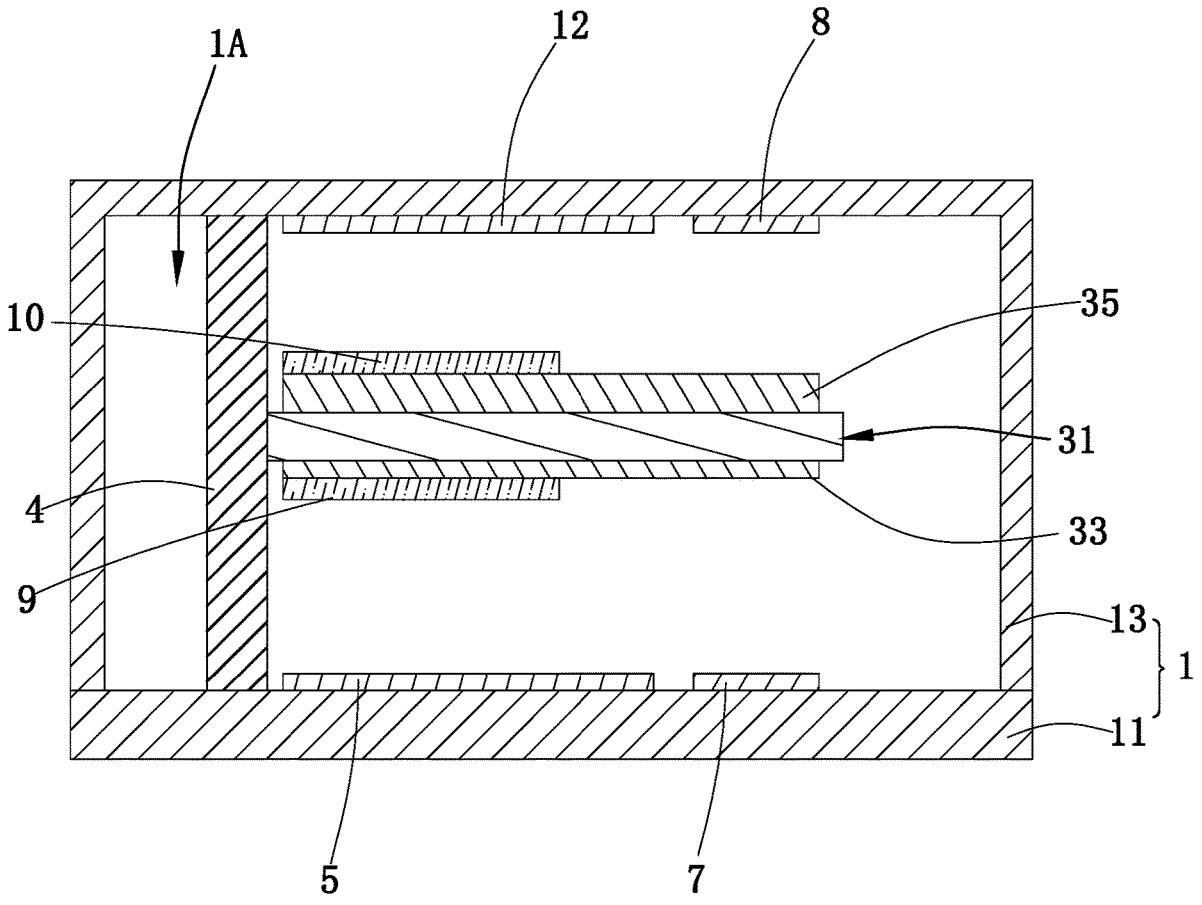
FIG. 8 is a schematic structural view of a MEMS switch including a first contacting member and a second contacting member with different thickness according to some embodiments of the present disclosure.

In some embodiments, as shown in FIG. 8, the core 31 may have a uniform average stress (that is, no stress gradient occurs in the core 31), and the stress of the first contacting member 33 may be the same as the stress of the second contacting member 35. However, the thickness of the first contacting member 33 may be different from or not equal to the thickness of the second contacting member 35, such that the stress gradient may be produced in the thickness direction of the switching assembly 3. For example, as shown in FIG. 8, the thickness of the first contacting member 33 may be less than the thickness of the second contacting member 35, and thus the stress gradient may be produced.

Figure 9:
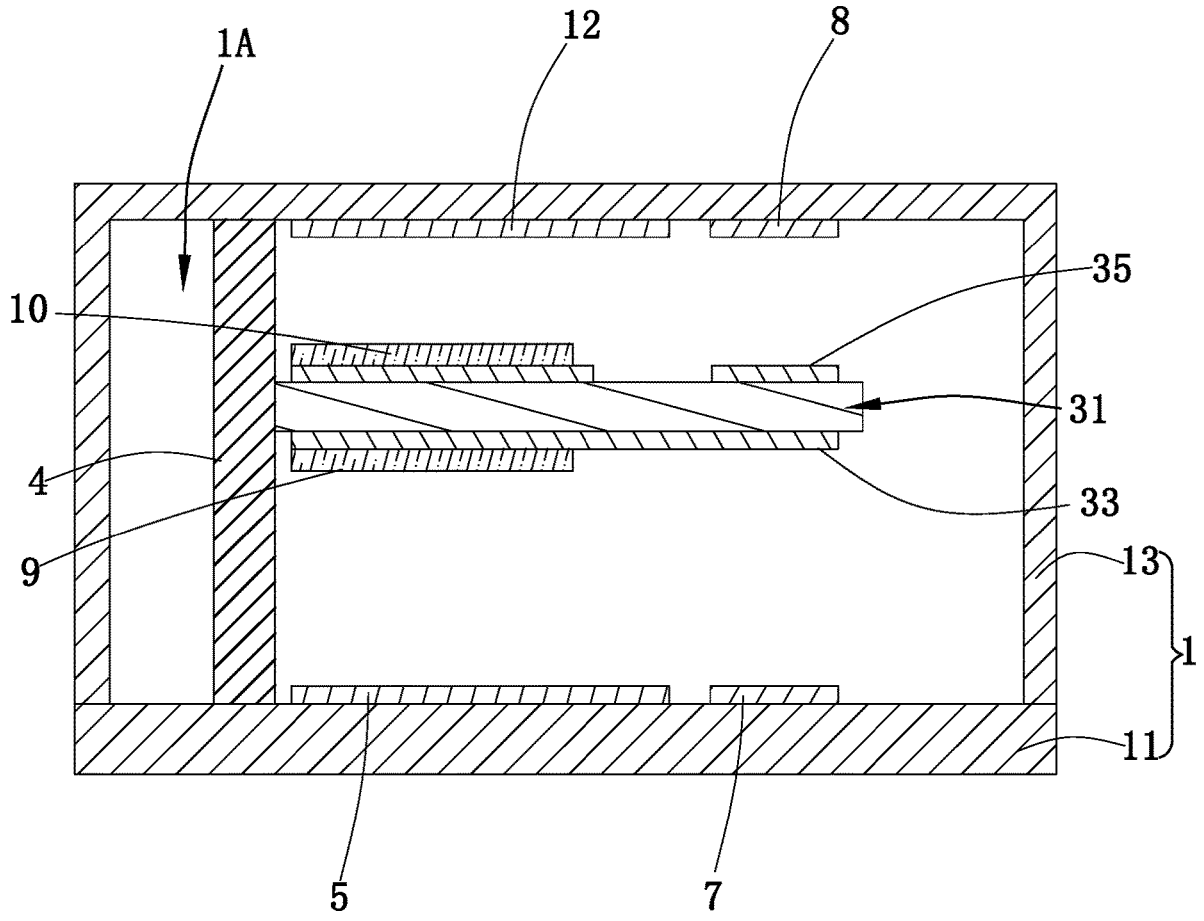
FIG. 9 is a schematic structural view of a MEMS switch including a first contacting member and a second contacting member with different pattern according to some embodiments of the present disclosure.

In some embodiments, as shown in FIG. 9, the core 31 may have a uniform average stress (that is, no stress gradient occurs in the core 31), and the first contacting member 33 and the second contacting member 35 may have the same stress and the same thickness. However, the pattern of the first contacting member 33 may be different from the pattern of the second contacting member 35, such that the stress gradient may be produced.

Figure 10:
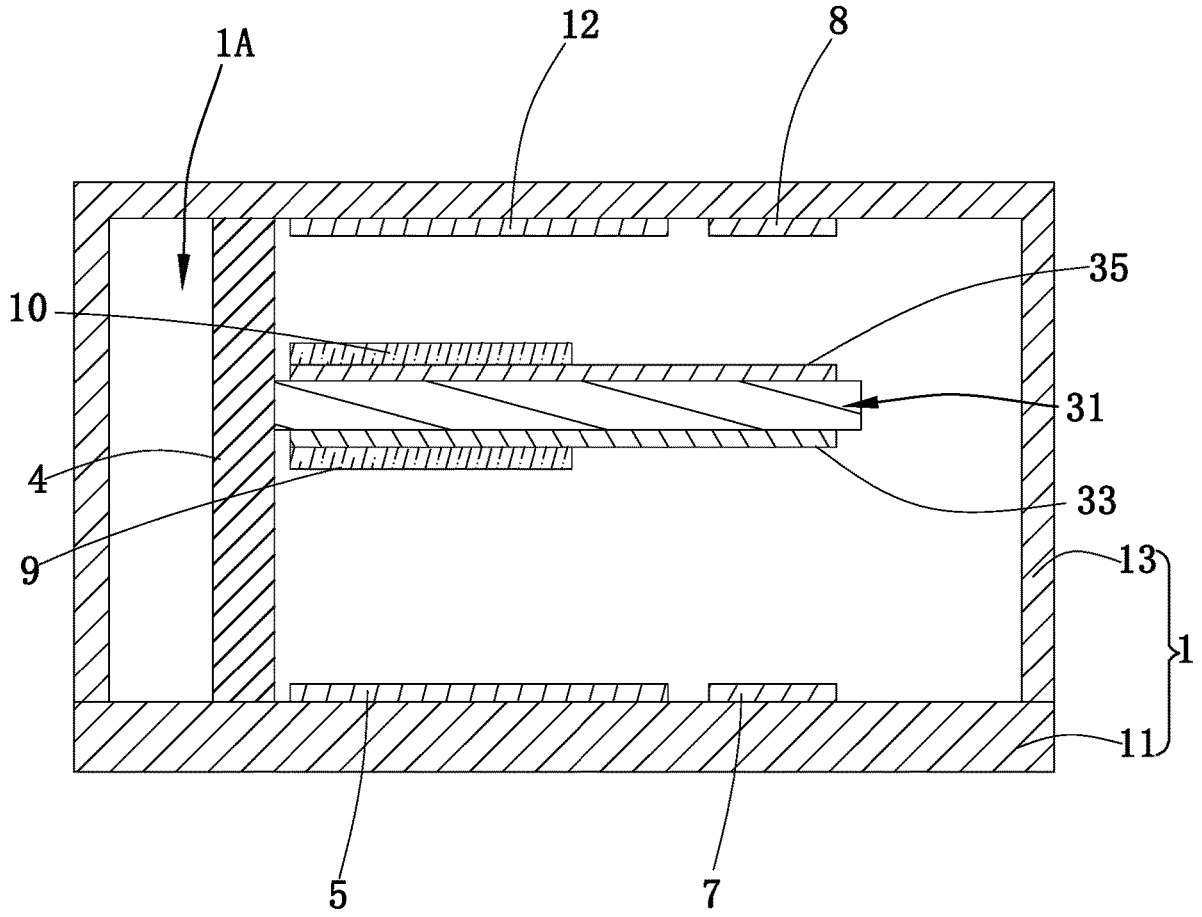
FIG. 10 is a schematic structural view of a MEMS switch including a first contacting member and a second contacting member made of different material according to some embodiments of the present disclosure.

In some embodiments, as shown in FIG. 10, the core 31 may have a uniform average stress (that is, no stress gradient occurs in the core 31), and the first contacting member 33 and the second contacting member 35 may have the same stress and the same thickness. However, the first contacting member 33 may be different from the second contacting member 35 in material, such that the stress gradient may be produced. For example, as shown in FIG. 10, the material of the first contacting member 33 may be TiN, while the material of the second contacting member 35 may be Ti/AlCu.

Figure 11:
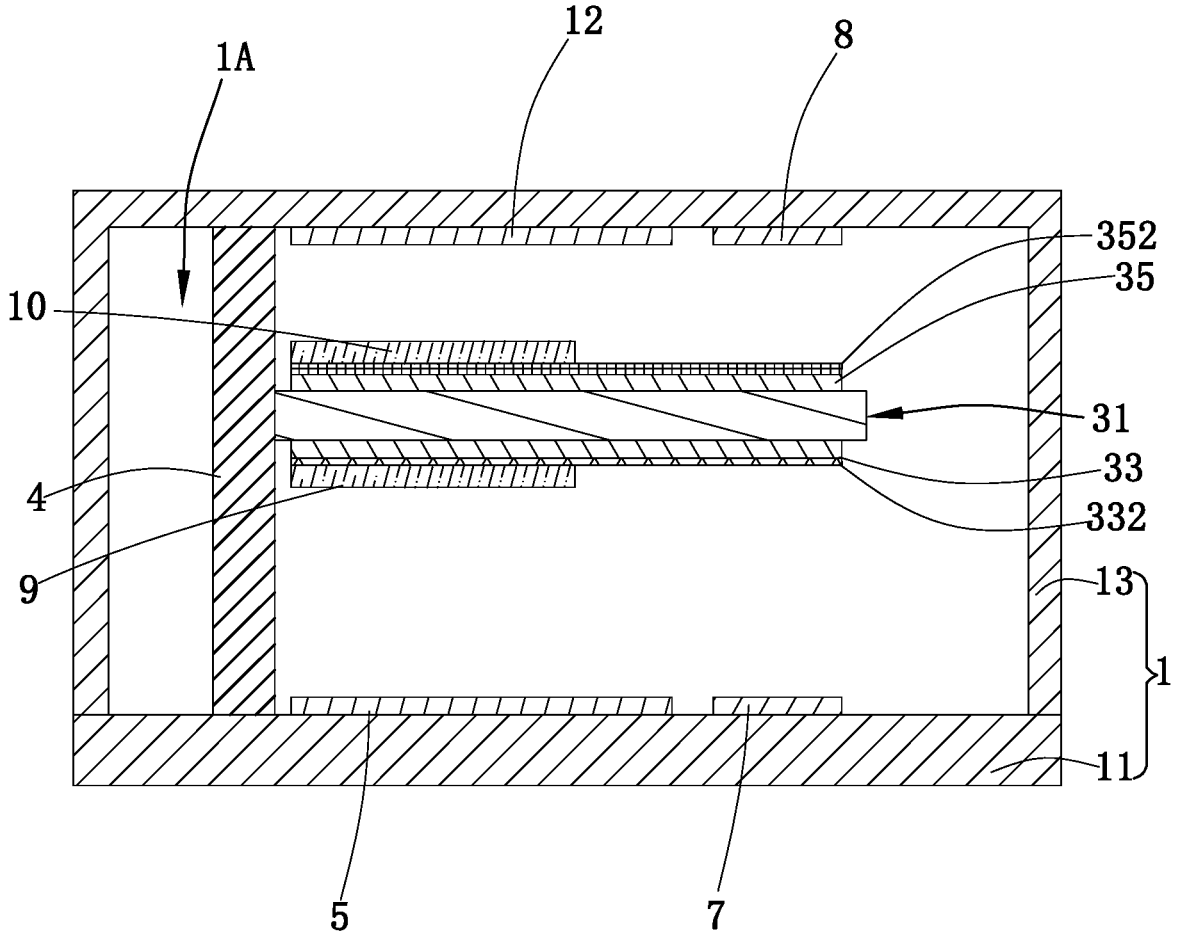
FIG. 11 is a schematic structural view of a MEMS switch including a first contacting member and a second contacting member with different stack orientation according to some embodiments of the present disclosure.

In some embodiments, as shown in FIG. 11, the core 31 may have a uniform average stress (that is, no stress gradient occurs in the core 31), and the first contacting member 33 and the second contacting member 35 may have the same stress and the same thickness. However, the first contacting member 33 may be different from the second contacting member 35 in stack orientation, such that the stress gradient may be produced. For example, as shown in FIG. 11, the first contacting member 33 may include a Ti/AlCu layer 332 on the bottom surface, while the second contacting member 35 may include a TiN layer 352 on the top surface.

Figure 12:
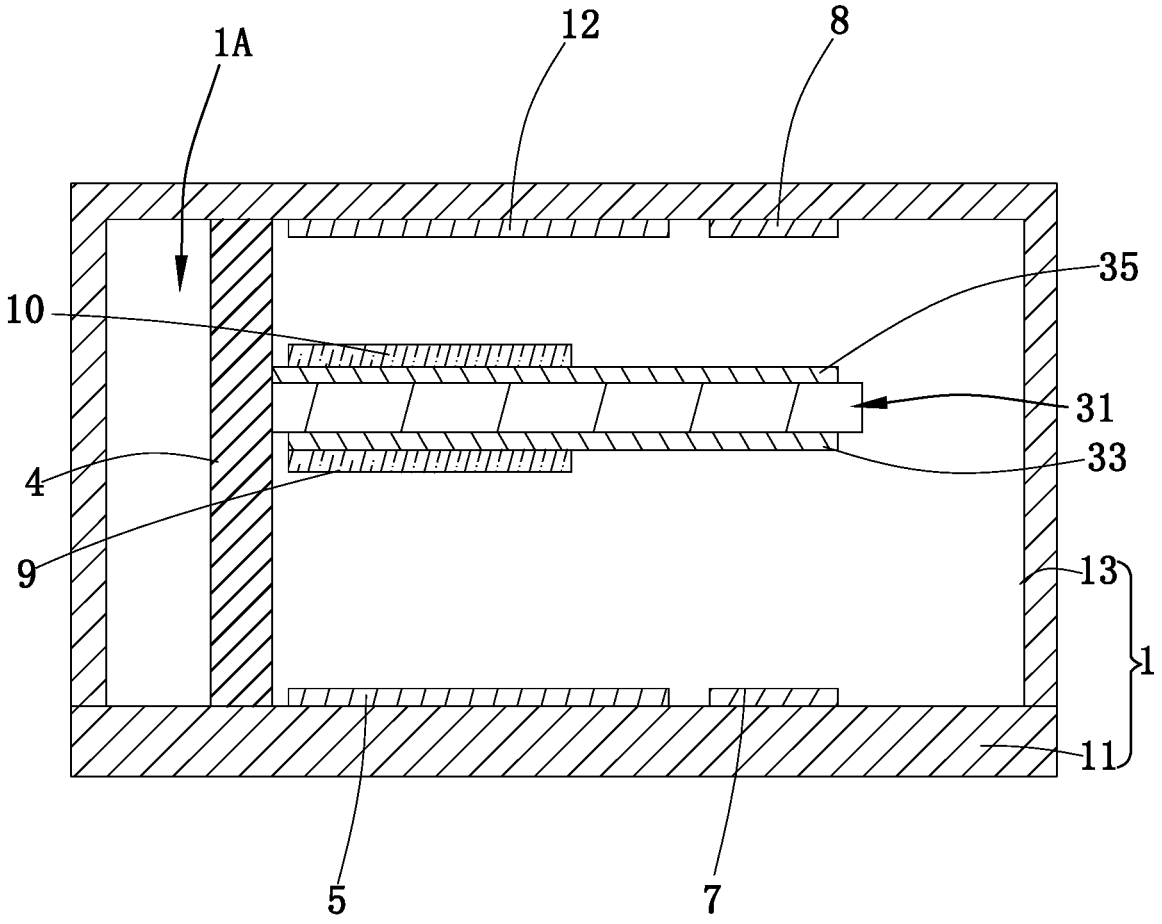
FIG. 12 is a schematic structural view of a MEMS switch including a first contacting member and a second contacting member with different length according to some embodiments of the present disclosure.

In some embodiments, it is also possible to modify an anchor or root of the switching assembly 3 at the first end 3A. For example, as shown in FIG. 12, a length of the first contacting member 33 in a direction substantially perpendicular to the thickness direction may be greater than a length of the core 31 in the direction substantially perpendicular to the thickness direction, such that the first contacting member 33 may be extended to cover the fixing member 4. A length of the second contacting member 35 in the direction substantially perpendicular to the thickness direction may be less than the length of the core 31. Thus, an effective stress gradient may be produced to cause the switching assembly 3 to deflect.

In some embodiments, the core 31 does not have a nominally uniform thickness structure and may be in shape of a step, that is to say, the core 31 may have a stepped structure. Thus, the stress gradient may also be generated in the switching assembly 3.

In some embodiments, the core 31 may be made of metal, and the core 31 itself may has a stress gradient in the thickness direction.

Figure 13:
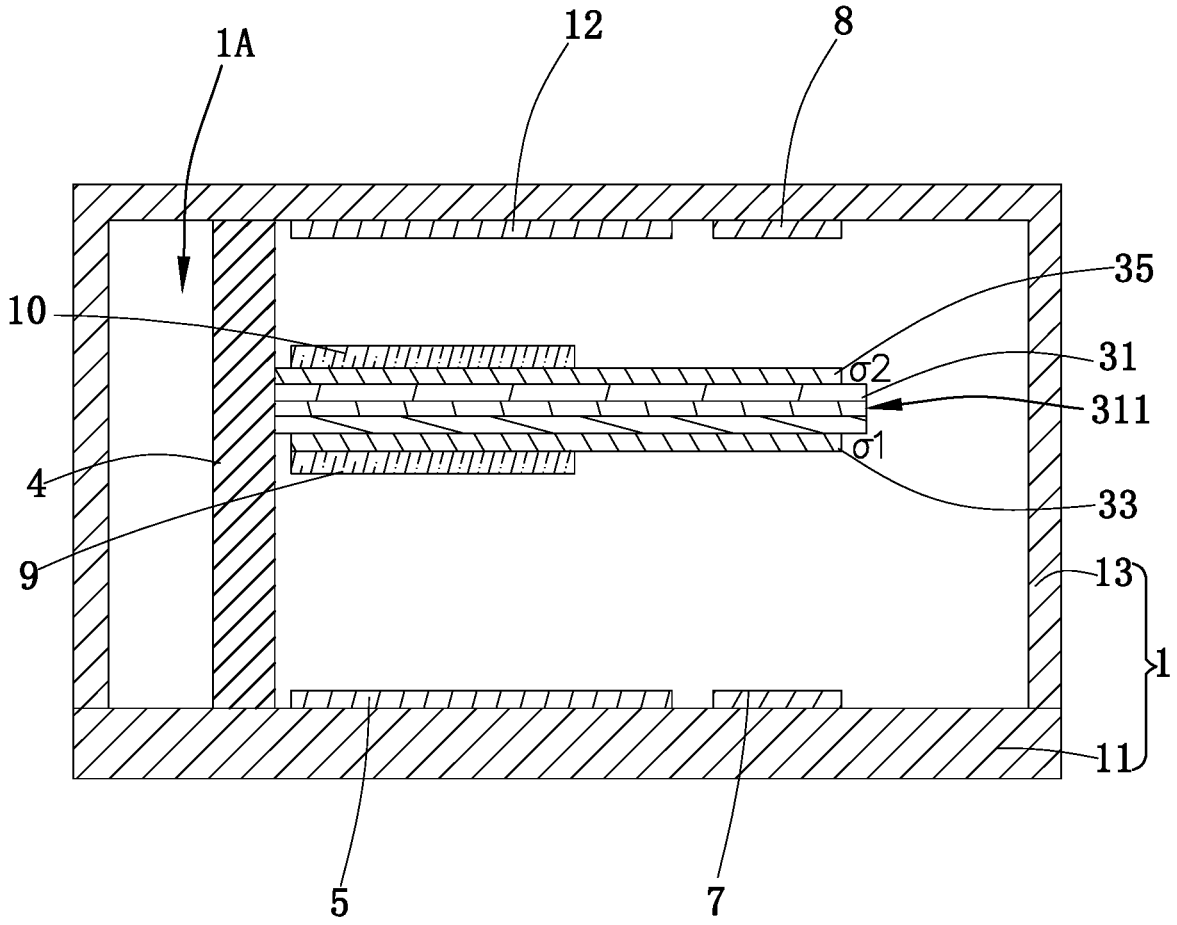
FIG. 13 is a schematic structural view of a MEMS switch including a first contacting member and a second contacting member with different stress and a core including three sub-layers according to some embodiments of the present disclosure.

In summary, any asymmetry in the thickness direction of the switching assembly 3 may produce an effective stress gradient. Besides, the stress gradient may be designed to produce a desired response (for example, the desired deflection) and may be based on a combination of all elements as described previously. For example, as shown in FIG. 13, the core 31 may include three sub-layers 311 having different stresses, and the first contacting member 33 and the second contacting member 35 may be different in stress, thickness, pattern, material, or the like. The specific ways to produce the stress gradient may not be limited in some embodiments of the present disclosure.

Furthermore, the first actuation electrode 5 may cooperate with the second actuation electrode 9, such that the switching assembly 3 may be driven to displace, and thus the first contacting member 33 may contact with the first contact 7, or the second contacting member 35 may contact with the second contact 8, or the switching assembly 3 may be driven to be spaced apart from the first contact 7 and the second contact 8.

The working process of the MEMS switch may be described in the following. In the following, the MEMS switch powered by electrostatic mechanisms may be taken as an example. As stated above, the MEMS switch is normally closed and is normally in the CLOSED1 state in response to applying no voltage between the first actuation electrode 5 and the second actuation electrode 9 and the stress gradient of the switching assembly 3 as shown in FIG. 3. In this state, the first contact 7 may contact with the first contacting member 33, such that the switching assembly 3 may be electrically connected to an external circuit. When a first voltage is applied between the third actuation electrode 12 and the fourth actuation electrode 10, the switching assembly 3 may be driven to deflect such that the switching assembly 3 may be spaced apart from both the first contact 7 and the second contact 8, and thus the switching assembly 3 may be disconnected from the external circuit. In this case, the MEMS switch is in the open state as shown in FIG. 1. When a second voltage is applied between the third actuation electrode 12 and the fourth actuation electrode 10, the second contacting member 35 may by driven to move towards the second contact 8 and further contact with the second contact 8, and the MEMS switch is in the CLOSED2 state at this time, as shown in FIG. 2.

When the first actuation electrode 5 and the second actuation electrode 9 contribute to the CLOSED1 state, a third voltage is applied on the first actuation electrode 5 and the second actuation electrode 9. It should be noted that the third voltage is smaller than the second voltage. Because the stress gradient of the switching assembly 3 makes itself curl towards the first contact 7, which reduce the deflection distance between the first contact 7 and the switching assembly 3.

Furthermore, since the MEMS switch is a normally closed switch, it is possible to provide protection against electrostatic discharge (ESD) or High Voltage Breakdown (VBD) when the MEMS switch is connected across a pair of terminals. The terminals can be electrically floating, not controlled by a specific voltage. The connection between the pair of terminals may be described by a capacitance, resistance, or inductance and may also be described as electrically isolated. When the MEMS switch as described in some embodiments of the present disclosure is applied across two isolated terminals, a low resistance conduction path is produced such that a high voltage (HV) is not developed across the terminals, and thus it is possible to reduce the possibility of having VBD or Electrical Overstress Damage (EOD) in case that the current is not limited. Of course, when one of the terminals is grounded or connected to a fixed voltage, the HV will not be developed.

In some embodiments, the MEMS switch may have a fixed resistance, which is a small result in a small voltage drop across the terminals.

In some embodiments, the first contacting member 33, the second contacting member 35, the first actuation electrode 5, the first contact 7, the second contact 8, and the second actuation electrode 9 may be made of materials of any combination of dielectric, conductor, and semiconductor as required. For example, the combination may include dielectric-dielectric, conductor-conductor, semiconductor-semiconductor, dielectric-conductor, dielectric-semiconductor, conductor-semiconductor, or the like. In some embodiments, the first contacting member 33, the second contacting member 35, the first actuation electrode 5, the first contact 7, the second contact 8, and the second actuation electrode 9 may be made of or composed of aluminum (or aluminum alloys such as Al-0.5% Cu, Al-0.5% Si, or the like), gold, copper, or other conductive materials. The materials of the first contacting member 33, the second contacting member 35, the first actuation electrode 5, the first contact 7, the second contact 8, and the second actuation electrode 9 will not be limited in some embodiments of the present disclosure.

As further shown in FIG. 1, the housing 1 may include a substrate 11 and a cover 13 assembled with the substrate 11, and the receiving space 1A may be formed or enclosed by the substrate 11 and the cover 13. The first actuation electrode 5 and the first contact 7 may be fixedly disposed on the substrate 11, and the switching assembly 3 may also be fixed to the substrate 11 via the fixing member 4. The second contact 8 may be fixedly disposed on the cover 13.

In some embodiments, the fixing member 4 may include but be not limited to, a post, a column, a bracket, or the like. The first end 3A of the switching assembly 3 may be connected to the fixing member 4 and the free end 3B of the switching assembly 3 may be rotatable about the first end 3A.

In some embodiments, as further shown in FIG. 1, the switching assembly 3 may further include a first dielectric member 37 fixed at one side of the first contacting member 33 that faces away from or that is opposite to the core 31, and the second actuation electrode 9 may be fixedly disposed on a surface of the first dielectric member 37 that faces away from the first contacting member 33. A second dielectric member 39 may be further fixed at one side of the second contacting member 35 that faces away from or is opposite to the core 31. The first dielectric member 37 may be patterned such that the first contacting member 33 may have a first contacting portion 331 which is exposed from the first dielectric member 37 and capable of contacting with the first contact 7 when the switching assembly 3 is deflected towards the first contact 7. The second dielectric member 39 may also be patterned such that the second contacting member 35 may have a second contacting portion 351 which is exposed from the second dielectric member 39 and capable of contacting with the second contact 8 when the switching assembly 3 is deflected towards the second contact 8.

In the embodiments as shown in FIG. 1, the second electrode 9 is disposed or fixed to the first dielectric member 37 at the first side 3C of the switching assembly 3. However, in some embodiments, it is possible that the second electrode 9 may be disposed or fixed to the second side 3D of the switching assembly 3. That is to say, the second electrode 9 may be disposed or fixed to the second dielectric member 39.

In some embodiments, the first core 31, the first dielectric member 37, and the second dielectric member 39 may be made of oxides. The oxide may be selected from the group consisting of silicon oxide, silicon nitride, and aluminum oxide.

In some embodiments, each of a thickness of the first dielectric member 37 and a thickness of the second dielectric member 39 may be less than a thickness of the core 31.

In the embodiments above, the switching assembly 3 may be implemented as a cantilever. However, in some embodiments, the switching assembly 3 may be implemented as a spring cantilever. For example, in some embodiments of the present disclosure, the MEMS switch may further include a spring. The first end 3A may be a fixed/constrained end which is constrained by the fixing member 4. The second end 3B may be a free end which may be free to displace to the extent allowed by the spring, and rotate within the limits of the spring constraint. In this way, it is possible to limit the deflections realized by a true cantilever. Compared with the switching assembly 3 implemented as a cantilever, the switching assembly 3 having the second end 3B connected to the spring may allow more displacement and more rotation. In some embodiments, the spring may be replaced by any elastic member which may provide an elastic force similarly to the spring. At this time, the switching assembly 3 may also be called as an elastic cantilever.

In some embodiments, the switching assembly 3 may also be implemented with a fixed-fixed or doubly-supported configuration. For example, in some embodiments of the present disclosure, the MEMS switch may further include an additional fixing member. The first end 3A is a fixed/constrained end which is constrained by the fixing member 4. The second end 3B may also be a fixed/constrained end which is constrained by the additional fixing member.

In some embodiments, the switching assembly 3 may also be implemented with a multi-supported configuration that is supported on multiple sides, edges or points.

Therefore, the geometric configuration of the switching assembly 3 can be achieved by a cantilever, a spring or elastic cantilever, a fixed-fixed configuration, or a multi-supported configuration, which will not be limited in some embodiments of the present disclosure. Besides, the transduction mechanisms for the switching assembly 3 of different configuration may be selected as required. When the switching assembly 3 is powered by electrostatic mechanisms, the voltage applied to the switching assembly 3 may be selected depending on the structure, geometry, and material properties of the switching assembly, which will not be specifically limited herein.

The above are only the embodiments of the present disclosure. It should be noted that those skilled in the art may make improvements without departing from the inventive concept of the present disclosure, but these belong to the protection scope of the present disclosure.

What is claimed is:

1. A MEMS (micro-electromechanical system) switch, comprising:

a housing, a switching assembly, received in the housing and having a first side and a second side opposite to the first side in a thickness direction of the switching assembly; wherein the switching assembly is switchable among a first closed state, a second closed state, and an open state;

a first actuation electrode, fixedly arranged on the housing, disposed at the first side of the switching assembly, and spaced apart from the switching assembly;

a first contact, fixedly arranged on the housing, disposed at the first side of the switching assembly, and spaced apart from the switching assembly and the first actuation electrode;

a second actuation electrode, fixedly disposed on the switching assembly and disposed correspondingly to the first actuation electrode;

a second contact, fixedly arranged on the housing, disposed at the second side of the switching assembly, and spaced apart from the switching assembly;

a third actuation electrode, fixedly arranged on the housing, disposed at the second side of the switching assembly, and spaced from the switching assembly; and a fourth actuation electrode, fixedly disposed on the switching assembly and disposed correspondingly to the third electrode;

wherein the switching assembly has a stress gradient along the thickness direction, such that in response to applying no voltage between the first actuation electrode and the second actuation electrode, the switching assembly is in the first closed state and contacts with the first contact;

in response to applying a first voltage between the third actuation electrode and the fourth actuation electrode, the switching assembly is driven to deflect such that the switching assembly is in the open state and spaced apart from both the first contact and the second contact; and in response to applying a second voltage between the third actuation electrode and the fourth actuation electrode, the switching assembly is driven to deflect such that the switching assembly is in the second closed state and contacts with the second contact;

the switching assembly further comprises a core, a first contacting member, disposed on the core at the first side of the switching assembly and facing towards the first contact, and a second contacting member, disposed on the core at the second side of the switching assembly and facing towards the second contact;

in response to the switching device being in the first closed state, the first contacting member contacts with the first contact; and in response to the switching device being in the second closed state, the second contacting member contacts with the second contact;

the core comprises at least two sub-layers, and stresses of the at least two sub-layers are different from each other; and/or the first contacting member has a first stress, and the second contacting member has a second stress which is not equal to the first stress; and/or the first contacting member has a first thickness, and the second contacting member has a second thickness which is not equal to the first thickness; and/or the first contacting member has a first pattern, and the second contacting member has a second pattern different from the first pattern; and/or the first contacting member is made of a first material, and the second contacting member is made of a second material different from the first material; and/or a length of the first contacting member in a direction substantially perpendicular to the thickness direction is greater than a length of the core in the direction substantially perpendicular to the thickness direction, and a length of the second contacting member in the direction substantially perpendicular to the thickness direction is less than the length of the core; and/or the core is in shape of a step; and/or the core is made of metal and has a stress gradient in the thickness direction.

2. The MEMS switch as claimed in claim 1, wherein the switching assembly has a first end fixed with respect to the housing and a second end free to displace and rotatable with respect to the housing;

wherein a distance from the first actuation electrode to the first end of the switching assembly is less than a distance from the first contact to the first end of the switching assembly.

3. The MEMS switch as claimed in claim 1, wherein the switching assembly further comprises:

a first dielectric member, fixed at one side of the first contacting member opposite to the core, and a second dielectric member, fixed at one side of the second contacting member opposite to the core;

wherein the first contacting member has a first contacting portion, and the first contacting portion is exposed from the first dielectric member and capable of contacting with the first contact when the switching assembly in the first closed state; and the second contacting member has a second contacting portion, and the second contacting portion is exposed from the second dielectric member and capable of contacting with the second contact when the switching assembly is in the second closed state.

4. The MEMS switch as claimed in claim 3, wherein the second actuation electrode is fixedly disposed on a surface of the first dielectric member that faces away from the first contacting member.

5. The MEMS switch as claimed in claim 3, wherein each of a thickness of the first dielectric member and a thickness of the second dielectric member is less than a thickness of the core.

6. The MEMS switch as claimed in claim 3, wherein each of the core, the first dielectric member, and the second dielectric member is made of oxide.

7. The MEMS switch as claimed in claim 1, wherein the housing comprises:

a substrate, and a cover, assembled with the substrate, wherein the cover and the substrate cooperatively form a receiving space, and the switching assembly is disposed in the receiving space;

wherein the first actuation electrode and the first contact are fixedly disposed on the substrate; and the second contact is fixedly disposed on the cover.

8. The MEMS switch as claimed in claim 7, further comprising a first fixing member;

wherein the switching assembly has a first end fixedly connected to the substrate via the first fixing member and a second end opposite to the first end;

wherein the second end of the switching assembly is free to displace and rotatable with respect to the housing; or the second end of the switching assembly is supported by an elastic member; or the second end of the switching assembly is fixedly connected to the substrate via a second fixing member.

9. The MEMS switch as claimed in claim 1, wherein the first actuation electrode and the first contact are disposed at the same side of the first contacting member that is opposite to the core.

10. A MEMS (micro-electromechanical system) switch, comprising:

a housing, a switching assembly, received in the housing and having a first side and a second side opposite to the first side in a thickness direction of the switching assembly;

a first actuation electrode, fixedly arranged on the housing and disposed at the first side of the switching assembly;

a first contact, fixedly arranged on the housing and disposed at the first side of the switching assembly;

a second actuation electrode, fixedly disposed on the switching assembly and disposed correspondingly to the first actuation electrode;

a second contact, fixedly arranged on the housing and disposed at the second side of the switching assembly;

a third actuation electrode, fixedly arranged on the housing, disposed at the second side of the switching assembly, and spaced from the switching assembly; and a fourth actuation electrode, fixedly disposed on the switching assembly and disposed correspondingly to the third electrode; and wherein the switching assembly is configured in such a way that the switching assembly contacts with the first contact and a short circuit is formed between the first contact and the switching assembly in response to applying no voltage between the first actuation electrode and the second actuation electrode;

the switching assembly comprises a core, a first contacting member, disposed on the core at the first side of the switching assembly and facing towards the first contact, and a second contacting member, disposed on the core at the second side of the switching assembly and facing towards the second contact;

in response to applying a first voltage between the third actuation electrode and the fourth actuation electrode, the switching assembly is deflected such that the first contacting member is spaced apart from the first contact and the second contacting member is spaced apart from the second contact; and in response to applying a second voltage between the third actuation electrode and the fourth actuation electrode, the switching assembly is deflected towards the second contact such that the second contacting member is capable of contacting with the second contact;

the core comprises at least two sub-layers, and stresses of the at least two sub-layers are different from each other; and/or the first contacting member has a first stress, and the second contacting member has a second stress which is not equal to the first stress; and/or the first contacting member has a first thickness, and the second contacting member has a second thickness which is not equal to the first thickness; and/or the first contacting member has a first pattern, and the second contacting member has a second pattern different from the first pattern; and/or the first contacting member is made of a first material, and the second contacting member is made of a second material different from the first material; and/or a length of the first contacting member in a direction substantially perpendicular to the thickness direction is greater than a length of the core in the direction substantially perpendicular to the thickness direction, and a length of the second contacting member in the direction substantially perpendicular to the thickness direction is less than the length of the core; and/or the core is in shape of a step; and/or the core is made of metal and has a stress gradient in the thickness direction.

11. The MEMS switch as claimed in claim 10, wherein the switching assembly has a first end fixed with respect to the housing and a second end free to displace and rotatable with respect to the housing;

wherein a distance from the first actuation electrode to the first end of the switching assembly is less than a distance from the first contact to the first end of the switching assembly.

12. The MEMS switch as claimed in claim 10, wherein the switching assembly further comprises:

a first dielectric member, fixed at one side of the first contacting member opposite to the core, and a second dielectric member, fixed at one side of the second contacting member opposite to the core;

wherein the first contacting member has a first contacting portion, and the first contacting portion is exposed from the first dielectric member and capable of contacting with the first contact when the switching assembly in the first closed state; and the second contacting member has a second contacting portion, and the second contacting portion is exposed from the second dielectric member and capable of contacting with the second contact when the switching assembly is in the second closed state.

13. The MEMS switch as claimed in claim 12, wherein the second actuation electrode is fixedly disposed on a surface of the first dielectric member that faces away from the first contacting member.

14. The MEMS switch as claimed in claim 12, wherein each of a thickness of the first dielectric member and a thickness of the second dielectric member is less than a thickness of the core.

15. The MEMS switch as claimed in claim 10, wherein the housing comprises:

a substrate, and a cover, assembled with the substrate, wherein the cover and the substrate cooperatively form a receiving space, and the switching assembly is disposed in the receiving space;

wherein the first actuation electrode and the first contact are fixedly disposed on the substrate; and the second contact is fixedly disposed on the cover.

* * * * *